US011557253B2

(12) United States Patent
Choi et al.

(10) Patent No.: US 11,557,253 B2
(45) Date of Patent: Jan. 17, 2023

(54) IMAGE RETENTION MITIGATION VIA VOLTAGE BIASING FOR ORGANIC LIGHTING-EMITTING DIODE DISPLAYS

(71) Applicant: Google LLC, Mountain View, CA (US)

(72) Inventors: Sangmoo Choi, Palo Alto, CA (US); Chang Ju Kang, San Jose, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 17/662,972

(22) Filed: May 11, 2022

(65) Prior Publication Data

US 2022/0270550 A1 Aug. 25, 2022

Related U.S. Application Data

(60) Provisional application No. 63/364,472, filed on May 10, 2022.

(51) Int. Cl.
*G09G 3/3258* (2016.01)

(52) U.S. Cl.
CPC ..... *G09G 3/3258* (2013.01); *G09G 2310/08* (2013.01); *G09G 2320/0219* (2013.01)

(58) Field of Classification Search
CPC ..... G09G 2300/043; G09G 2300/0819
See application file for complete search history.

(56) References Cited

U.S. PATENT DOCUMENTS

| | | | | |
|---|---|---|---|---|
| 9,697,758 | B2 | 7/2017 | Watanabe et al. | |
| 10,510,317 | B2 | 12/2019 | Spence et al. | |
| 10,861,389 | B2 * | 12/2020 | Lin | G09G 3/3258 |
| 11,403,984 | B2 | 8/2022 | Jung et al. | |
| 2015/0287352 | A1 | 10/2015 | Watanabe et al. | |
| 2016/0078838 | A1 | 3/2016 | Huang et al. | |
| 2016/0078846 | A1 | 3/2016 | Liu et al. | |
| 2017/0092196 | A1 | 3/2017 | Gupta et al. | |
| 2018/0151109 | A1 | 5/2018 | Shim et al. | |
| 2018/0158415 | A1 | 6/2018 | Chaji et al. | |
| 2018/0301080 | A1 | 10/2018 | Shigeta et al. | |
| 2021/0201731 | A1 | 7/2021 | Ranjan et al. | |

(Continued)

FOREIGN PATENT DOCUMENTS

| | | |
|---|---|---|
| CN | 112331145 | 2/2021 |
| CN | 113053306 | 6/2021 |

(Continued)

OTHER PUBLICATIONS

Parikh, et al., "Novel Driving Scheme to Remove Residual Image Sticking in AMOLED", Jan. 2008, 4 pages.

(Continued)

*Primary Examiner* — Van N Chow
(74) *Attorney, Agent, or Firm* — Colby Nipper PLLC

(57) ABSTRACT

This document describes systems and techniques for image retention mitigation via voltage biasing for organic light-emitting diode (OLED) displays. In aspects, a pixel array is described having pixel circuits including a first transistor configured to receive a biasing signal from one or more drivers and, based on the biasing signal, enable or disable an application of a bias voltage at a terminal of a second transistor. In so doing, the bias voltage reduces a hysteresis effect experienced by the second transistor for each of the multiple pixel circuits of the pixel array, thereby mitigating an image retention.

5 Claims, 6 Drawing Sheets

(56) References Cited

U.S. PATENT DOCUMENTS

| | | | | |
|---|---|---|---|---|
| 2022/0059016 | A1* | 2/2022 | Baek | G09G 3/3233 |
| 2022/0059030 | A1* | 2/2022 | Sang | G09G 3/3233 |
| 2022/0130308 | A1 | 4/2022 | Jung et al. | |
| 2022/0208074 | A1* | 6/2022 | Kim | G09G 3/30 |

FOREIGN PATENT DOCUMENTS

| | | |
|---|---|---|
| KR | 20160080768 | 7/2016 |
| KR | 102279278 | 7/2021 |
| WO | 2022105484 | 5/2022 |

OTHER PUBLICATIONS

Triggs, "What is screen burn in and how can you prevent it?", https://www.androidauthority.com/screen-burn-in-801760/, Mar. 25, 2022, 12 pages.

Choi, et al., "Disabling Transitions When Encoded Intensity is Low", Application No. PCT/US2021/070522, filed May 10, 2021, 46 pages.

Karri, et al., "User Interface Mitigation of Display Artifacts During Transitions between Display Clock Speeds", Technical Disclosure Commons, https://www.tdcommons.org/dpubs_series/5427, Nov. 4, 2022, 7 pages.

Shin, et al., "Dynamic Voltage Scaling of OLED Displays", Jun. 2011, 6 pages.

Yonebayashi, et al., "High refresh rate and low power consumption AMOLED panel using top-gate n-oxide and p-LTPS TFTs", Mar. 2020, 10 pages.

* cited by examiner

IMAGE RETENTION MITIGATION VIA VOLTAGE BIASING FOR ORGANIC LIGHTING-EMITTING DIODE DISPLAYS

RELATED APPLICATION

This application claims priority under 35 U.S.C. § 119(e) to U.S. Provisional Patent Application 63/364,472, filed on May 10, 2022 which is incorporated herein by reference in its entirety.

SUMMARY

This document describes systems and techniques for image retention mitigation via voltage biasing for organic light-emitting diode (OLED) displays. In aspects, a pixel array is described having pixel circuits including a first transistor configured to receive a biasing signal from one or more drivers and, based on the biasing signal, enable or disable an application of a bias voltage at a terminal of a second transistor. In so doing, the bias voltage reduces a hysteresis effect experienced by the second transistor for each of the multiple pixel circuits of the pixel array, thereby mitigating an image retention.

In aspects, a display is disclosed that includes: a pixel array including multiple pixel circuits, one or more of the multiple pixel circuits is disclosed that includes: an organic light-emitting diode (OLED) configured to illuminate; a first transistor having a first source terminal, a gate terminal, and a first drain terminal, the first transistor configured to receive a first voltage at the source terminal; and a second transistor having a second source terminal; an electrical line operably coupled to each of the multiple pixel circuits via the first source terminal, the electrical line configured to transmit the first voltage to the first transistor; and a scan-line driver operably coupled to each of the multiple pixel circuits via the gate terminal of the first transistor, the scan-line driver configured to: generate a biasing signal; and supply the biasing signal to the gate terminal of the first transistor, the biasing signal configured to: produce a second voltage, based on the first voltage, at the first drain terminal of the first transistor, the second voltage configured to initialize, during a display-frame period, an electrical voltage of the second source terminal of the second transistor to neutralize a voltage stress experienced across the second transistor to reduce a hysteresis effect, effective to mitigate an image retention on the pixel array.

This Summary is provided to introduce simplified of concepts systems and techniques for image retention mitigation via voltage biasing for OLED displays, the concepts of which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of systems and techniques for image retention mitigation via voltage biasing for OLED displays are described in this document with reference to the following drawings, in which the user of same numbers in different instances may indicate similar features or components.

DETAILED DESCRIPTION

Overview

This document describes systems and techniques for image retention mitigation via voltage biasing for OLED displays. Many electronic devices (e.g., smartphones, tablets, virtual-reality (VR) goggles) include displays. Such displays often use organic light-emitting diode (OLED) technology, utilizing tens of thousands of pixel circuits each having their own organic light-emitting diode. The benefits of OLED displays include high refresh rates, small display response times, and low power consumption. These benefits make OLED displays well-suited for electronic devices, and are further appreciated by users, in large part, because of their display image-quality.

In some circumstances, for instance OLED displays configured to display on-screen content for extended durations and/or at high luminosities, OLED displays may experience image retention (e.g., image persistence, "ghosting"). Image retention may present noticeable optical artifacts that can affect the visibility of current on-screen content. As a result, electronic device users, who often prize OLED displays for the image-quality, may be annoyed by the noticeable optical artifacts produce by, or associated with, image retention.

As an example, depending on an intensity, a duration, and/or a frame rate at which an OLED display previously operated at to display a previous image ("a previous display stress time"), the OLED display may retain noticeable on-screen artifacts (e.g., dark regions, bright regions) while displaying successive images. For instance, an OLED display may be configured to display an image, or a variation of the image having one or more similar patterns, for seconds, minutes, or, even, hours (e.g., persistent on-screen content, always-on-display (AOD)). Also, the display may be configured to display the image at various luminosities, which may further influence a magnitude and a duration of the image retention. In one example, a smartwatch may include an OLED display that is configured to display an image having a plurality of patterns collectively resembling a clock (e.g., a clock face), including one or more of an hour hand, a minute hand, a second hand, a dial, hours, minutes, and so on. One or more of the plurality of patterns, or variations thereof, may be configured to persist within a region of the OLED display for an extended length of time. As a result, pixel circuits having light-emitting components (e.g., light-emitting diodes (LEDs)) that collectively illuminate to generate on-screen content and, thereby, reproduce the plurality of patterns on the OLED display may receive, as a non-limiting example, a high-voltage signal for the extended length of time, causing a hysteresis effect at one or more transistors. This hysteresis effect, experienced at one or more transistors of multiple pixel circuits, can cause the OLED display to retain on-screen artifacts associated with one or more of the plurality of patterns in successive images.

Example Environment

Figure 1:
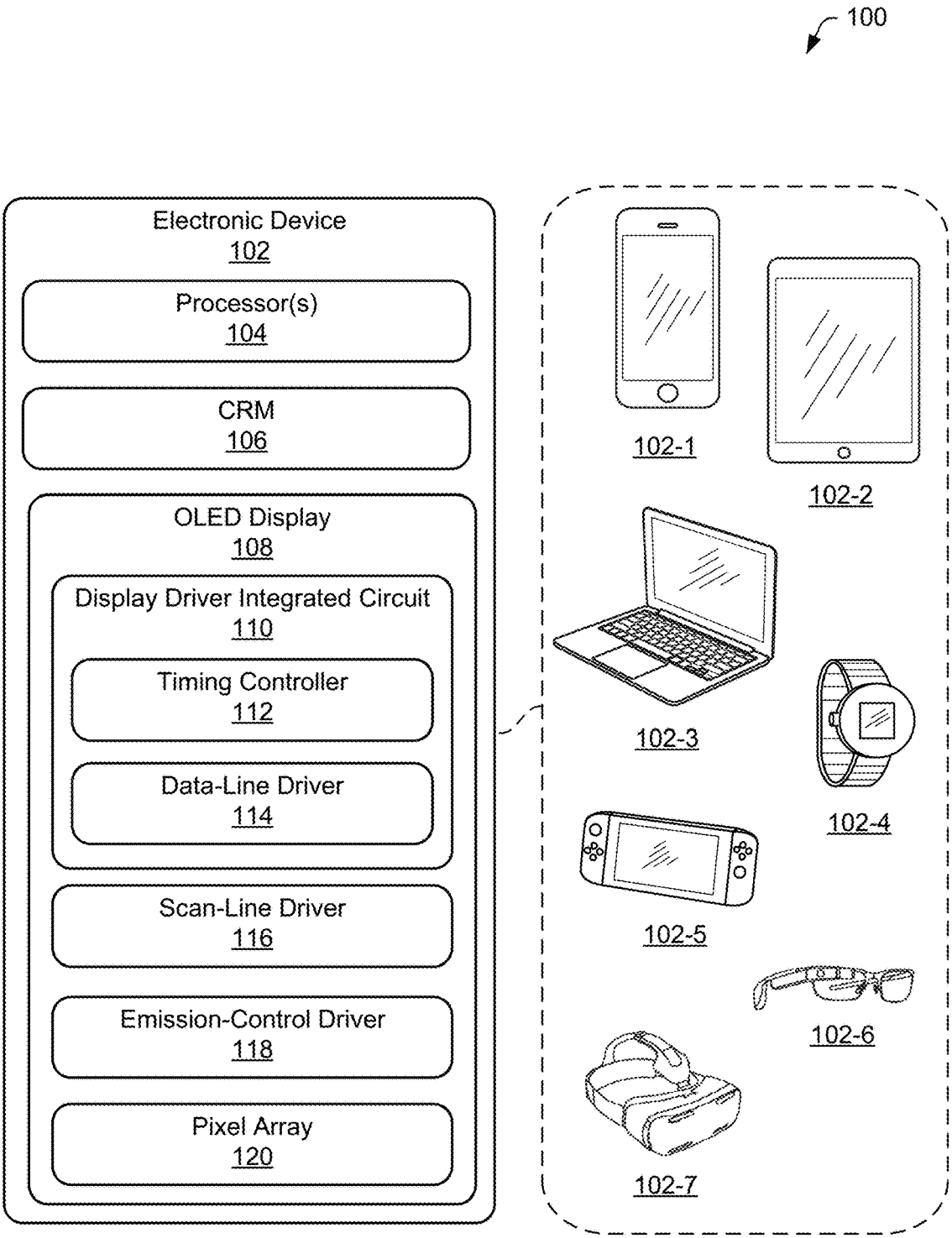
FIG. 1 illustrates an example device diagram of an electronic device in which image retention mitigation via voltage biasing for OLED displays can be implemented.

FIG. 1 illustrates an example device diagram 100 of an electronic device 102 in which image retention mitigation via voltage biasing for OLED displays can be implemented. The electronic device 102 may include additional components and interfaces omitted from FIG. 1 for the sake of clarity. The electronic device 102 can be a variety of consumer electronic devices. As non-limiting examples, the electronic device 102 can be a mobile phone 102-1, a tablet device 102-2, a laptop computer 102-3, a computerized watch 102-4, a portable video game console 102-5, smart glasses 102-6, VR goggles 102-7, and the like.

The electronic device 102 includes one or more processors 104 operably connected to a timing controller 112. The processor(s) 104 can include, as non-limiting examples, a system on a chip (SoC), an application processor (AP), a central processing unit (CPU), or a graphics processing unit (GPU). The processor(s) 104 generally execute commands and processes utilized by the electronic device 102 and an operating system installed thereon. For example, the processor(s) 104 may perform operations to display graphics of the electronic device 102 on the OLED display 108 and can perform other specific computational tasks, such as controlling the creation and display of an image on the OLED display 108.

The electronic device 102 also includes computer-readable storage media (CRM) 106. The CRM 106 is a suitable storage device (e.g., random-access memory (RAM), static RAM (SRAM), dynamic RAM (DRAM), non-volatile RAM (NVRAM), read-only memory (ROM), flash memory) configured to store device data of the electronic device 102, user data, and multimedia data. The CRM may store an operating system that generally manages hardware and software resources (e.g., the applications) of the electronic device 102 and provides common services for applications stored on the CRM. The operating system and the applications are generally executable by the processor(s) 104 to enable communications and user interaction with the electronic device 102.

The electronic device 102 further includes an OLED display 108 having a display driver integrated circuit 110 (DDIC 110). The DDIC 110 may include a timing controller 112 and at least one data-line driver 114 (e.g., a column-line driver). The OLED display 108 may further include one or more of a scan-line driver 116 and an emission-control driver 118. In additional implementations, the OLED display 108 may include a gate-line driver (not illustrated) and/or additional row-line drivers.

Further, the OLED display 108 may include a pixel array 120 of pixel circuits. The pixel array 120 may be controlled by a timing controller 112 via the data-line driver 114, the scan-line driver 116, and the emission-control driver 118. In other implementations, a timing controller 112 and a plurality of scan-line drivers, data-line drivers, and emission-control drivers may control the pixel circuits of a pixel array 120. As illustrated in FIG. 1, the DDIC 110 includes the data-line driver 114. In additional implementations, the data-line driver 114 may be separate from the DDIC 110 but operably coupled to the DDIC 110. In further implementations, the timing controller 112 may include the data-line driver 114.

The timing controller 112 provides interfacing functionality between the processor(s) 104 and the drivers (e.g., data-line driver 114, scan-line driver 116, emission-control driver 118) of the OLED display 108. The timing controller 112 generally accepts commands and data from the processor(s) 104, generates signals with appropriate voltage, current, timing, and demultiplexing, and transmits the signals to the data-line driver 114, the scan-line driver 116, and the emission-control driver 118 to enable the OLED display 108 to display a desired image.

The drivers may transmit time-variant and amplitude-variant signals (e.g., voltage signals, current signals) to control the pixel array 120. For example, the data-line driver 114 transmits signals containing voltage data to the pixel array 120 to control the luminance of an organic light-emitting diode. The scan-line driver 116 transmits a signal to enable or disable an organic light-emitting diode to receive the data voltage from the data-line driver 114. The emission-control driver 118 supplies an emission-control signal to the pixel array 120. Together, under the direction of the processor(s) 104, the drivers control the pixel array 120 to generate light to create an image on the OLED display 108.

Figure 2:
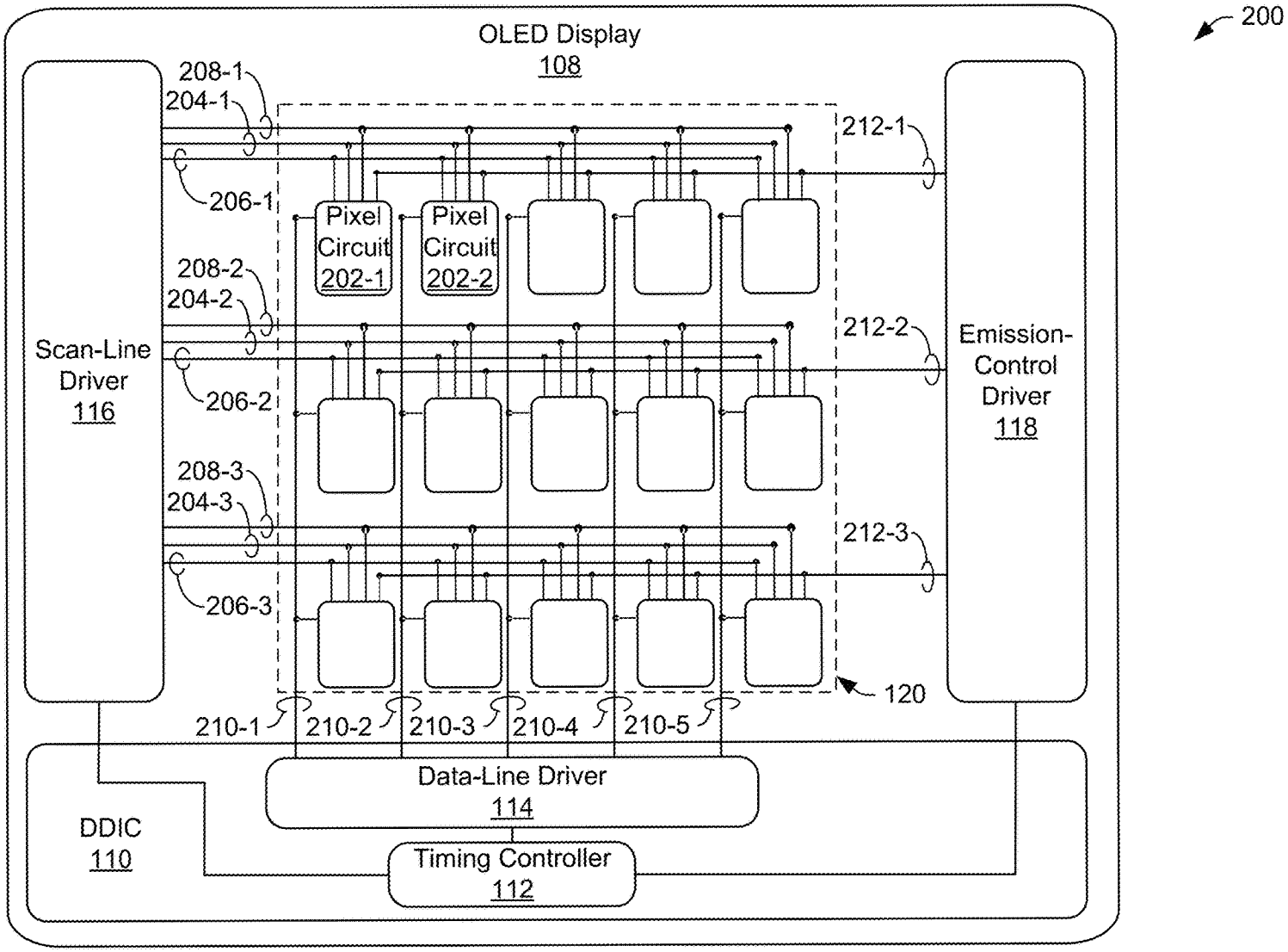
FIG. 2 illustrates an example device diagram of the OLED display in which image retention mitigation via voltage biasing for OLED displays can be implemented.

FIG. 2 illustrates an example device diagram 200 of the OLED display 108 in which image retention mitigation via voltage biasing for OLED displays can be implemented. In this example, the OLED display 108 includes similar components to those described and illustrated with respect to the OLED display 108 of FIG. 1, with some additional detail. The OLED display 108 can include additional components, which are not illustrated in FIG. 2. In additional implementations, the electronic device 102 may implement the techniques described herein using any of a variety of displays, including an active-matrix OLED (AMOLED) display, an electroluminescent display (ELD), a microLED display, a liquid crystal display (LCD), a thin film transistor (TFT) LCD, an in-place switching (IPS) LCD, a plasma monitor panel (PDP), and so forth.

As illustrated, the OLED display 108 includes a pixel array 120 of pixel circuits 202 (e.g., pixel circuit 202-1, pixel circuit 202-2). The OLED display 108 may contain a plurality (e.g., hundreds, thousands, millions) of pixel circuits 202, but only fifteen pixel circuits 202 are illustrated in FIG. 2 for sake of clarity. To control the pixel circuits 202, a processor (e.g., processor(s) 104) may transmit data to the DDIC 110. The timing controller 112 in the DDIC 110 may receive the signal and transmit signals with appropriate voltage, current, timing, and demultiplexing to the drivers. As a result, the drivers may transmit a series of signals via row or column lines to one or more pixel circuits 202 arranged in rows and columns. As illustrated, the scan-line driver 116 may transmit scan signals 204 (e.g., scan signal 204-1, scan signal 204-2, scan signal 204-3), time-shifted scan signals 206 (e.g., time-shifted scan signal 206-1, time-shifted scan signal 206-2, time-shifted scan signal 206-3), and biasing signals 208 (e.g., biasing signal 208-1, biasing signal 208-2, biasing signal 208-3) via row lines. The data-line driver 114 may transmit data signals 210 (e.g., data signal 210-1, data signal 208-2, data signal 208-3, data signal 208-4, data signal 208-5) via column lines. The emission-control driver 118 may transmit emission-control signals 212 (e.g., emission-control signal 212-1, emission-control signal 212-2, emission-control signal 212-3) via row lines.

As an example, the scan-line driver 116 can generate and supply the scan signal 204-1 to pixel circuits 202 (e.g., pixel circuit 202-1, pixel circuit 202-2) operably coupled to a first row of scan lines. The scan-line driver 116 may also be configured to generate and supply a time-shifted scan signal 206-1 to the pixel circuits 202 operably coupled to a first row of time-shifted scan lines. The scan-line driver 116 may further be configured to generate and supply a biasing signal 208-1 to the pixel circuits 202 operably coupled to a first row of biasing lines. In an implementation, the time-shifted scan signals 206 and biasing signals 208 may be scan signals 204 advanced forward in time by predefined intervals. In further implementations, an additional row-line driver may generate and supply the biasing signals 208.

Figure 3:
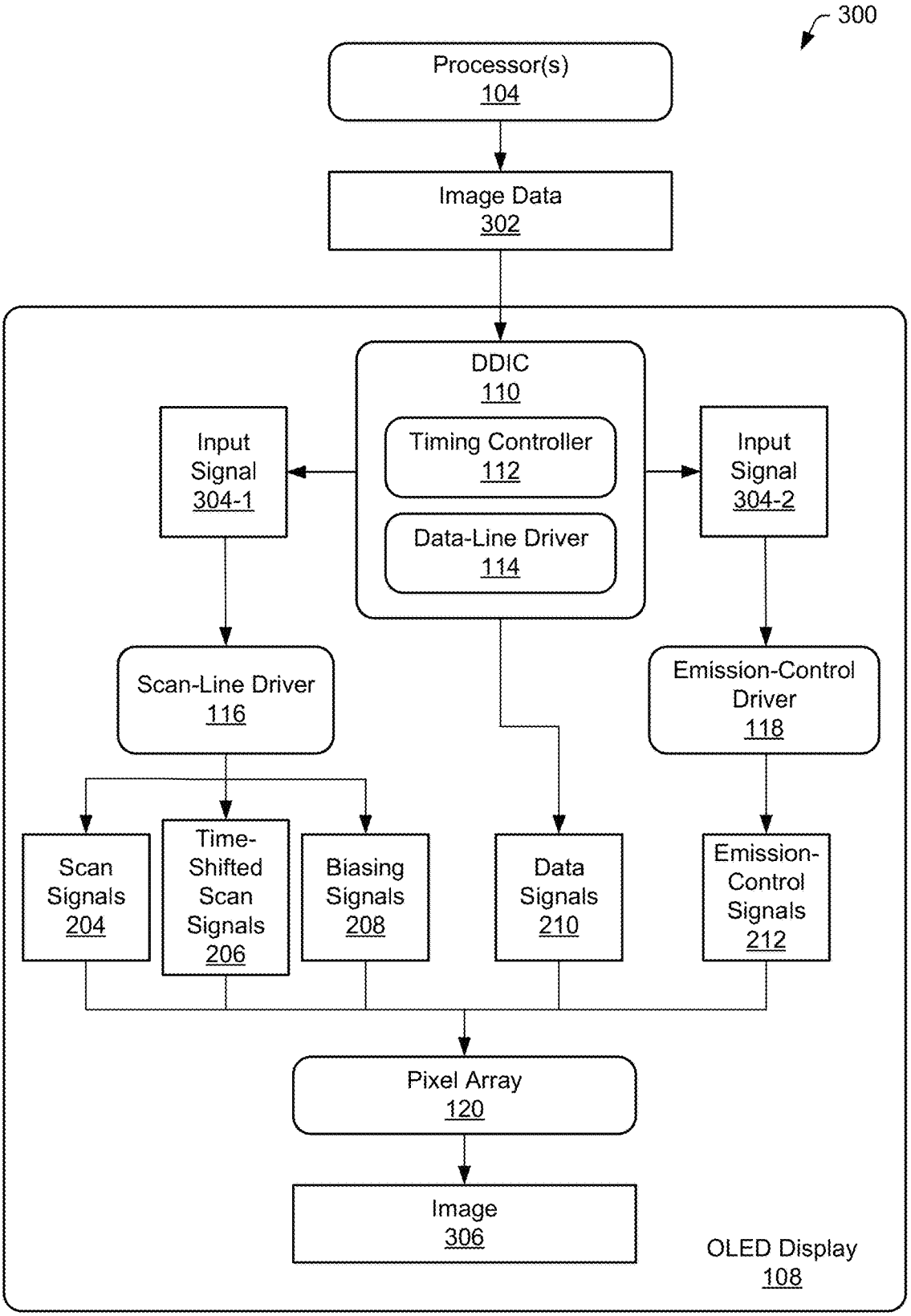
FIG. 3 is a schematic view illustrating example elements of an electronic device configured to receive, generate, and/or supply signals to produce an image on the OLED display.

FIG. 3 is a schematic view 300 illustrating example elements of an electronic device 102 configured to receive, generate, and/or supply signals to produce an image on the OLED display 108. The schematic view 300 is shown as a set of components and outputs (e.g., signals, data) thereof, but are not necessarily limited to the order or combinations shown. In portions of the following discussion, the schematic view 300 is described in the context of the OLED display 108 of FIGS. 1 and 2, or to entities or processes as detailed in other figures, reference to which is made for example only. The schematic view 300 may include outputs in a different order or with additional or fewer components and outputs thereof. Further, any of one or more of the outputs of schematic view 300 may be repeated, combined, reorganized, or linked to provide a wide array of additional and/or alternate outputs.

As described with respect to FIG. 1, the electronic device 102 includes processor(s) 104 (e.g., a GPU) to control the creation and display of an image 306 on the OLED display 108. As illustrated in FIG. 3, the processor(s) 104 transmits image data 302 to the DDIC 110 having the timing controller 112 and the data-line driver 114. The image data 302 includes information regarding the image 306. The timing controller 112 may process the image data 302 and generate input signals 304 (e.g., input signal 304-1, input signal 304-2). The timing controller 112 may supply an input signal 304-1 to the scan-line driver 116 and an input signal 304-2 to the emission-control driver 118.

The scan-line driver may generate and supply scan signals 204, time-shifted scan signals 206, and biasing signals 208 to the pixel circuits 202 within the pixel array 120 through the scan lines, time-shifted scan lines, and biasing lines, respectively, as illustrated in FIG. 2, for example. The data-line driver may generate and supply data signals 210 to the pixel circuits 202 within the pixel array 120 through the data lines, as illustrated in FIG. 2, for example. The emission-control driver 118 may generate and supply emission-control signals 208 to the pixel circuits 202 within the pixel array 120 through the emission-control lines, as illustrated in FIG. 2, for example.

Figure 4A:
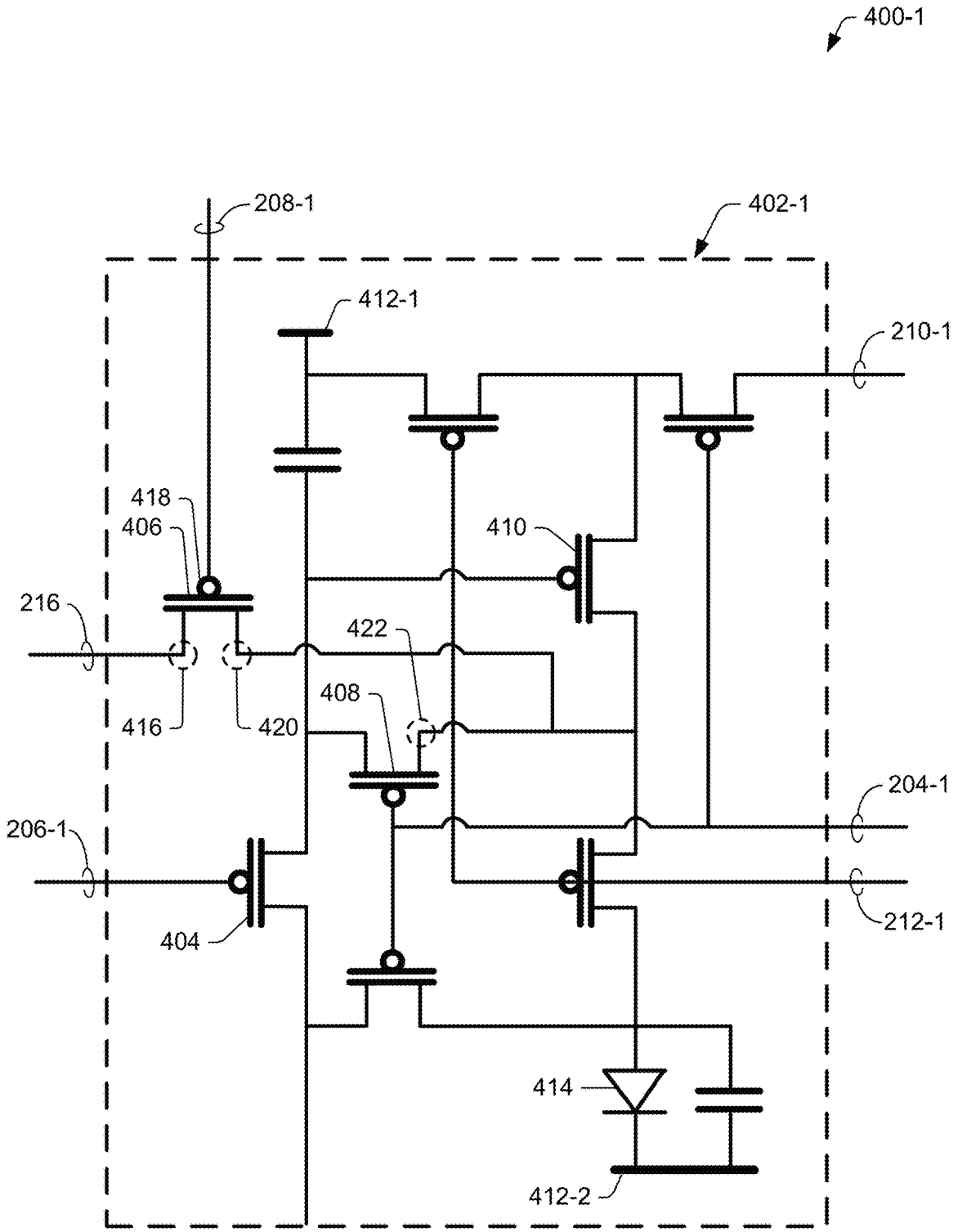
FIG. 4A illustrates an example pixel circuit as an example detailed circuit diagram.

FIG. 4A illustrates an example pixel circuit (e.g., pixel circuit 402-1) as an example detailed circuit diagram 400-1. As illustrated in the circuit diagram 400-1, the pixel circuit 402-1 is similar to the pixel circuit 202-1 described with respect to FIG. 2, with some additional detail. The pixel circuit 402-1 can include additional components, which are not illustrated in FIG. 4A. Further, some components of the pixel circuit 402-1 may not be labeled for the sake of clarity.

In aspects, the pixel circuit 402-1 may be implemented in the OLED display 108 of the electronic device 102. The pixel circuit 402-1 may contain circuit elements including thin-film transistors (TFTs) (e.g., TFT 404, TFT 406, TFT 408, TFT 410) voltage supplies 412 (e.g., voltage supply 412-1, voltage supply 412-2), and an organic light-emitting diode 414. In implementations, not labeled in FIG. 4, the pixel circuit 402-1 may include one or more capacitors. In additional implementations, the pixel circuit 402-1 may include inductors and operational amplifiers (Op Amps), as well as other electronic switches including bipolar junction transistors (BJTs) and insulated gate bipolar transistors (IGBTs).

The TFTs may be p-channel and/or n-channel metal-oxide-semiconductor field-effect transistors (MOSFETs) having thin films of an active semiconductor layer and a dielectric layer, as well as metallic contacts over a supporting substrate. In an implementation, as illustrated in FIG. 4A, the TFTs are p-channel MOSFETs. In operation, one or more of the TFTs (e.g., TFT 404, TFT 406, TFT 408) function as a series of switches, enabling or disabling current to flow through the pixel circuit 402-1 to and/or from one or more components therein, including the organic light-emitting diode 414, based on alternating voltage levels (e.g., a high voltage, a low voltage) of one or more driver signals (e.g., scan signal 204-1, time-shifted scan signal 206-1, biasing signal 208-1, data signal 210-1, emission-control signal 212-1). For example, TFT 408 is a p-channel MOSFET, enabling current flow when the scan signal 204-1 includes a low voltage.

In an example, the data-line driver (e.g., data-line driver 114) can send the data signal 210-1 to the pixel circuit 402-1 (and the other pixel circuits operatively coupled to the data-line driver through the data line). In an additional example, the scan-line driver (e.g., scan-line driver 116) can transmit the scan signal 204-1 with a low voltage to the pixel circuit 402-1 (and other pixel circuits operatively coupled to the scan-line driver through the scan line). In an implementation, the scan signal 204-1 may include, at separate time intervals, a high voltage and a low voltage. The scan-line driver can transmit the scan signal 204-1 having a low voltage to activate at least TFT 408 (e.g., close the switch) and enable current flow. The scan-line driver can also transmit the scan signal 204-1 having a high voltage to deactivate TFT 408 (e.g., open the switch) and disable current flow.

In aspects, to mitigate image retention on OLED displays, which may be caused by a hysteresis effect at TFT 408, a bias voltage may be applied to a source terminal 422 of TFT 408, while TFT 408 is turned off, to neutralize a voltage stress at TFT 408. As illustrated in FIG. 4A, a bias voltage line 216 (e.g., an electrical line, a wire, a circuit trace) having a bias voltage may be coupled to a source terminal 416 of TFT 406. If a biasing signal 208-1 having a low voltage is transmitted to a gate terminal 418 of TFT 406, then the bias voltage, or another voltage based on or associated with the bias voltage, may be transmitted through TFT 406 to a drain terminal 420. In such an operation, the bias voltage may be transmitted through the pixel circuit 402-1 and applied to the source terminal 422 of TFT 408 via a shared electrode. Accordingly, the bias voltage may reduce a voltage stress experienced across the source terminal 420 and a drain terminal (not labelled) of TFT 408. In so doing, supplying (e.g., application of) the bias voltage at the source terminal 422 of TFT 408 can reduce a hysteresis effect experienced by TFT 408 by initializing (e.g., reducing, resetting) the source terminal 422 voltage.

In implementations, the bias voltage can be dynamically controlled and adjusted based on (i) other driver signals, (ii) an organic light-emitting diode luminance, and/or (iii) a duration of luminance. In further implementations, the bias voltage may be a voltage similar to a data voltage configured to make the organic light-emitting diode 414 to remain dark (e.g., no illumination). In additional implementations, the bias voltage may be an even higher voltage than a data voltage configured to make the organic light-emitting diode 414 to remain dark. Further, the bias voltage may be a data voltage similar to a voltage configured to make the organic light-emitting diode 414 emit white light. As an example, over an extended duration (e.g., 1 minute, 5 minutes) a pixel circuit (e.g., pixel circuit 402-1) receives a data signal (e.g., data signal 210-1) configured to cause an organic light-emitting diode (e.g., organic light-emitting diode 414) to emit a shade of black. The pixel circuit receiving the data signal configured to cause the organic light-emitting diode to emit the shade of black may cause a transistor within the pixel circuit to experience a hysteresis effect. To counteract this, the bias voltage may be dynamically adjusted to be at a low voltage (e.g., a voltage configured to make the organic light-emitting diode 414 emit a white shade).

Due to a timing of the biasing signal 208-1 having the low voltage, with respect to a timing of other driver signals, TFT 406 may permit a flow of current to enable the application of the bias voltage at the source terminal 422 of TFT 408 at intervals when other TFTs in the pixel circuit 402-1 are open. As a result, the bias voltage may not be directly applied to the organic light-emitting diode 414 and, therefore, may not emit a color or shade associated with the bias voltage.

Figure 4B:
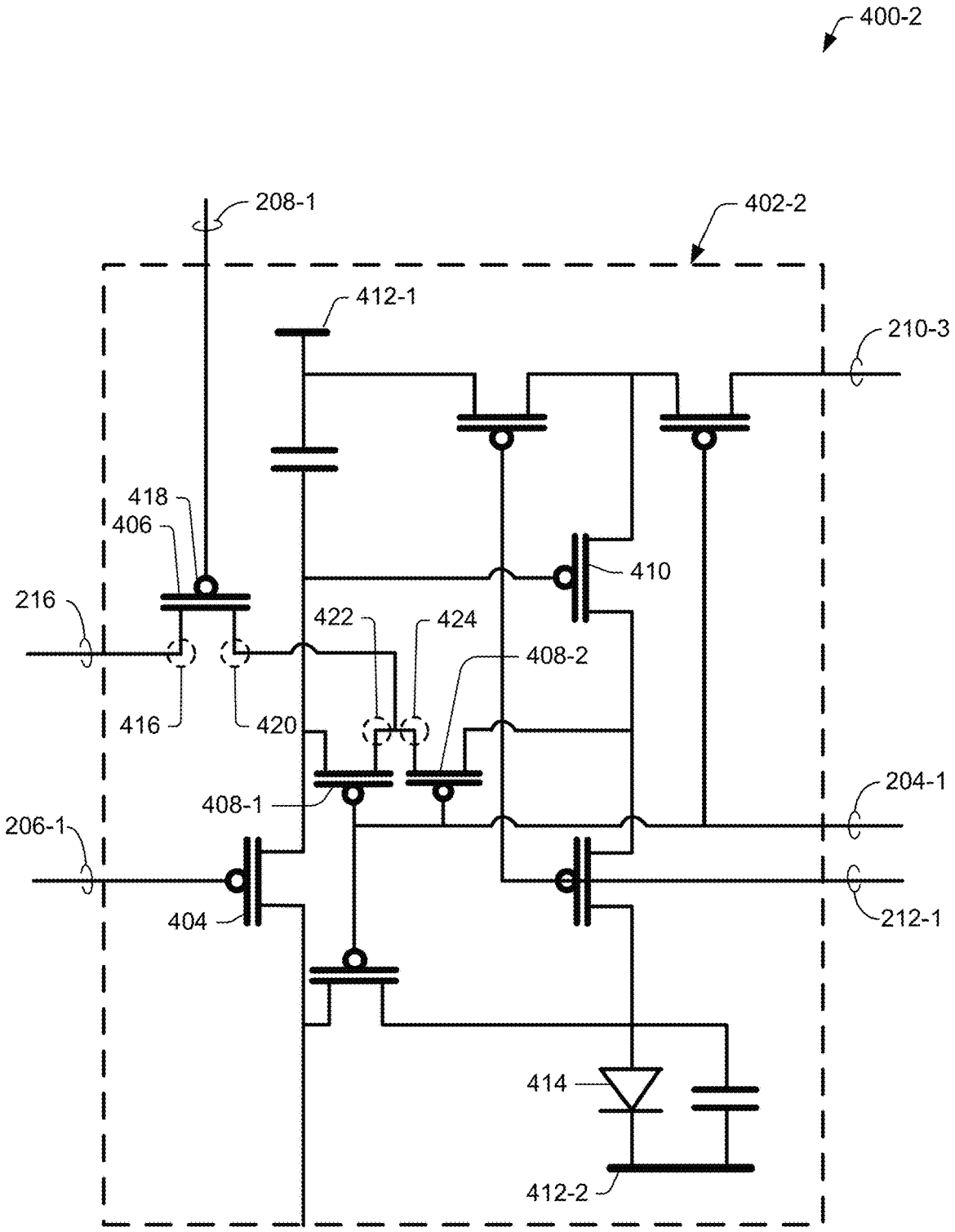
FIG. 4B illustrates another example pixel circuit as an example detailed circuit diagram.

FIG. 4B illustrates another example pixel circuit (e.g., pixel circuit 402-2) as an example detailed circuit diagram 400-2. As illustrated in the circuit diagram 400-2, the pixel circuit 402-2 is similar to the pixel circuit 202-1 described with respect to FIG. 2, with some additional detail. The pixel circuit 402-2 can include additional components, which are not illustrated in FIG. 4B. Further, some components of the pixel circuit 402-2 are not labeled.

As illustrated, pixel circuit 402-2 may include a plurality of components similar to pixel circuit 402-1 but may additionally, or in substitute, include TFT 408-1 and TFT 408-2, which may be implemented as a dual-gate transistor (e.g., a dual-gate switch). In such a configuration, potential leakage current from one or more TFTs may be minimized and image retention can be mitigated. For example, as illustrated in FIG. 4B, a bias voltage line 216 (e.g., a wire, a circuit trace) having a bias voltage may be coupled to a source terminal 416 of TFT 406. If a biasing signal 208-1 having a low voltage is transmitted to a gate terminal 418 of TFT 406, then the bias voltage, or another voltage based on or associated with the bias voltage, may be transmitted through TFT 406 to a drain terminal 420. In such an operation, the bias voltage may be transmitted through the pixel circuit 402-2 and applied to the source terminal 422 of TFT 408-1 and a drain terminal 424 of TFT 408-2 via a shared electrode. The bias voltage may reduce a voltage stress experienced across the source terminal 420 and a drain terminal (not labeled) of TFT 408-1, as well as a voltage stress experienced across a source terminal (not labeled) and the drain terminal 424 of TFT 408-2. In so doing, supplying (e.g., application of) the bias voltage at the source terminal 422 of TFT 408-1 and the drain terminal 424 of TFT 408-2 can reduce a hysteresis effect experienced by TFT 408-1 and/or TFT 408-2 and reduce potential leakage current by initializing (e.g., reducing, resetting) a source terminal 420 voltage.

Figure 5:
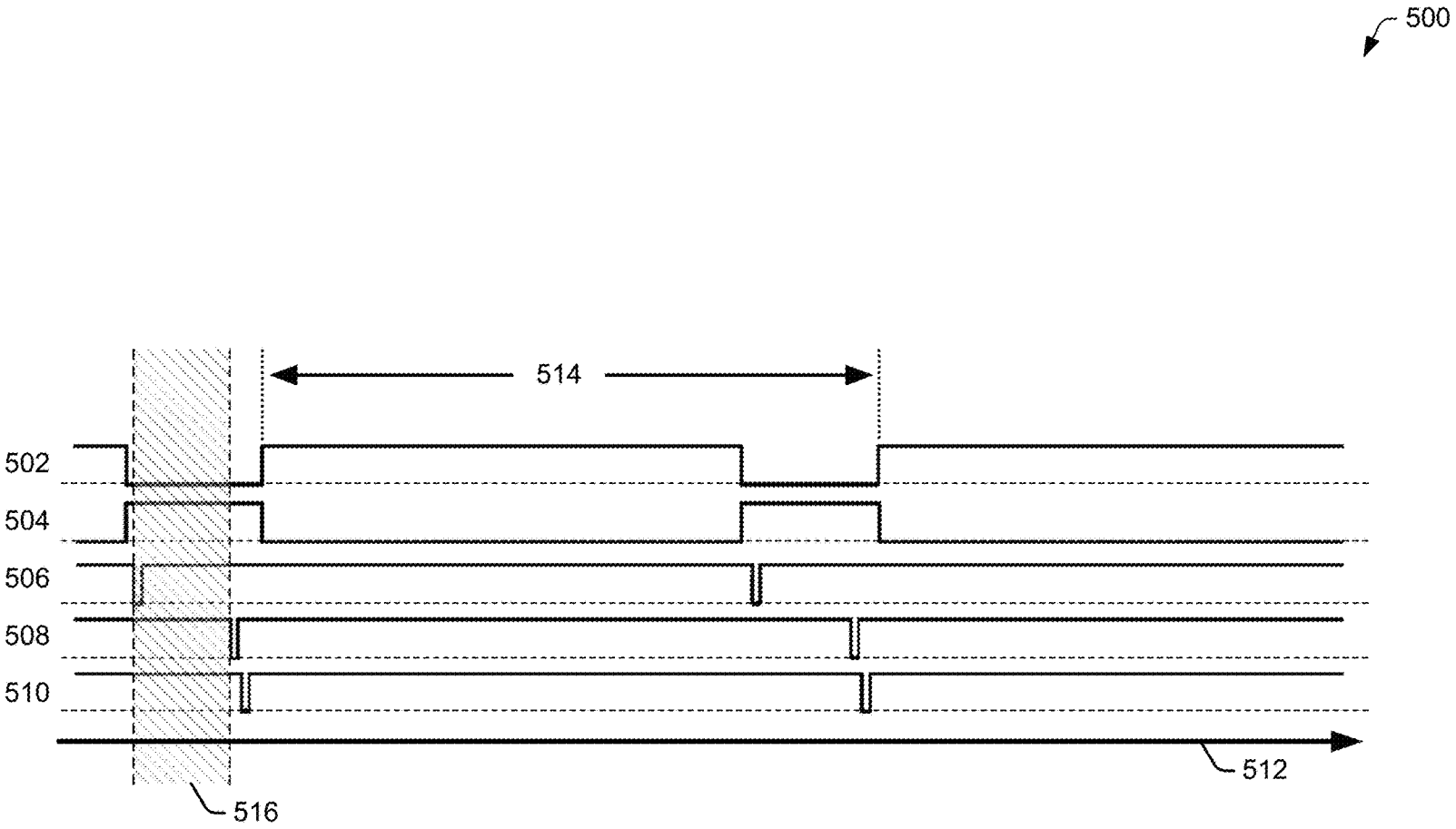
FIG. 5 graphically illustrates a timing diagram of an example pixel circuit.

FIG. 5 graphically illustrates a timing diagram 500 of an example pixel circuit (e.g., pixel circuit 402-1, pixel circuit 402-2). As illustrated, the timing diagram 500 depicts multiple waveforms representing a pixel luminance waveform 502 (e.g., a luminance of the organic light-emitting diode associated with pixel circuit 402-1), a emission-control signal waveform 504 (e.g., emission-control signal 212-1), a biasing signal waveform 506 (e.g., biasing signal 208-1), a time-shifted scan signal waveform 508 (e.g., time-shifted scan signal 206-1), and a scan signal waveform 510 (e.g., scan signal 204-1). Each of the waveforms are illustrated with respect to a shared time domain 512.

For instance, the pixel luminance waveform 502 is illustrated with respect to the shared time domain 512, and further depicts a range of luminosities, including a high luminosity and a low luminosity (e.g., no luminosity). As an example, during an interval 514 of the pixel luminance waveform 502, an organic light-emitting diode emits light (e.g., during the high luminosity) and does not emit light (e.g., during the low luminosity). In implementations, the interval 514 may correspond to a frame time. An organic light-emitting diode may have a low luminance (e.g., a low luminosity depicted on the pixel luminance waveform 502) in response to an emission-control driver (e.g., emission-control driver 118) transmitting an emission-control signal (e.g., emission-control signal 212-1) having in a high voltage.

As illustrated, the emission-control signal waveform 504 includes a high voltage when the pixel luminance waveform 502 includes a low luminosity. Further, the emission-control signal waveform 504 includes a low voltage when the pixel luminance waveform 502 includes a high luminosity. In implementations, referring back to FIGS. 4A and 4B as examples, the organic light-emitting diode 414 emitting light may be a result of the emission-control signal 212-1 having a low voltage and, thereby, activating one or more TFTs and enabling current flow to the organic light-emitting diode 414.

Further illustrated, a scan-line driver (e.g., scan-line driver 116), or another driver, may generate a biasing signal (e.g., biasing signal 208-1), depicted as biasing signal waveform 506, which may include a high voltage and a low voltage. Referring back to FIGS. 4A and 4B as examples, when the biasing signal 208-1 includes the low voltage, TFT 406 may activate enabling the bias voltage to reduce a voltage stress experienced at TFT 408 or TFT 408-1 and/or TFT 408-2. As illustrated in FIG. 5, a bias voltage region 516, resultant to the biasing signal having a low voltage, corresponds to a time during which, for example, TFT 408 may experience the effects of the bias voltage. For example, referring back to FIG. 4A, when the biasing signal 208-1 transmits a low voltage, the bias voltage is applied to the source terminal 422 of TFT 408. A previous voltage of the source terminal 422 is altered (e.g., increased, decreased) to the bias voltage. As a result, until, for example, a scan-line driver 116 transmits a time-shifted scan signal (e.g., time-shifted scan signal 206-1) having a low voltage (as illustrated in FIG. 5), a voltage of the source terminal 422 may retain the bias voltage and a voltage difference between a drain terminal (not labeled) and the source terminal 422 of TFT 408 may remain constant. In this way, application of the bias voltage at the source terminal 420 of TFT 408 can reduce a hysteresis effect and mitigate image retention.

What is claimed is:

1. A display comprising:

a pixel array including multiple pixel circuits, one or more of the multiple pixel circuits comprising:

an organic light-emitting diode (OLED) configured to illuminate;

a first transistor having a first source terminal, a gate terminal, and a first drain terminal, the first transistor configured to receive a first voltage at the source terminal; and a second transistor having a second source terminal;

an electrical line operably coupled to each of the multiple pixel circuits via the first source terminal, the electrical line configured to transmit the first voltage to the first transistor; and a scan-line driver operably coupled to each of the multiple pixel circuits via the gate terminal of the first transistor, the scan-line driver configured to:

generate a biasing signal; and supply the biasing signal to the gate terminal of the first transistor, the biasing signal configured to:

produce a second voltage, based on the first voltage, at the first drain terminal of the first transistor, the second voltage configured to initialize, during a display-frame period, an electrical voltage of the second source terminal of the second transistor to neutralize a voltage stress experienced across the second transistor to reduce a hysteresis effect, effective to mitigate an image retention on the pixel array.

2. The display of claim 1, wherein one or more of the multiple pixel circuits further comprises:

a third transistor having a second drain terminal electrically coupled to the second source terminal, and wherein the second voltage is configured to initialize, during the display-frame period, a second electrical voltage of the second drain terminal.

3. The display of claim 1, further comprising one or more pixel circuits not having the first transistor.

4. The display of claim 1, wherein the biasing signal comprises a voltage configured to cause the organic light-emitting diode to remain dark.

5. The display of claim 1, wherein the biasing signal comprises a voltage configured to cause the organic light-emitting diode to illuminate a shade of white.

* * * * *